US009701432B2

(12) United States Patent
Bernhard et al.

(10) Patent No.: US 9,701,432 B2
(45) Date of Patent: Jul. 11, 2017

(54) APPLICATOR DEVICE FOR WRAPPING LABELS

(71) Applicant: Bizerba GmbH & Co. KG, Balingen (DE)

(72) Inventors: Juergen Bernhard, Empfingen (DE); Holger Offermann, Messstetten (DE); Sebastian Ruff, Grosselfingen (DE); Armin Weckenmann, Dormettingen (DE); Marc Naschke, Balingen (DE)

(73) Assignee: BIZERBA GMBH & CO. KG, Balingen (DE)

( * ) Notice: Subject to any disclaimer, the term of this patent is extended or adjusted under 35 U.S.C. 154(b) by 232 days.

(21) Appl. No.: 14/376,362

(22) PCT Filed: Feb. 5, 2013

(86) PCT No.: PCT/EP2013/052253
§ 371 (c)(1),
(2) Date: Aug. 1, 2014

(87) PCT Pub. No.: WO2013/117554
PCT Pub. Date: Aug. 15, 2013

(65) Prior Publication Data

US 2015/0007936 A1 Jan. 8, 2015

(30) Foreign Application Priority Data

Feb. 6, 2012 (DE) ..... 10 2012 002 250

(51) Int. Cl.
*B65C 9/08* (2006.01)
*B65C 9/18* (2006.01)
(Continued)

(52) U.S. Cl.
CPC ..... *B65C 9/08* (2013.01); *B65C 1/025* (2013.01); *B65C 1/042* (2013.01); *B65C 9/1815* (2013.01);
(Continued)

(58) Field of Classification Search
CPC ..... B65C 1/042; B65C 9/1815; B65C 9/36; B65C 9/08; B65C 9/30; B65C 1/025; Y10T 156/10; Y10T 156/1768
See application file for complete search history.

(56) References Cited

U.S. PATENT DOCUMENTS 4,473,429 A 9/1984 Crankshaw
5,635,017 A 6/1997 Morrow
(Continued)

FOREIGN PATENT DOCUMENTS

DE 542606 C 1/1932
DE 616370 C 9/1935
(Continued)

OTHER PUBLICATIONS

Search Report mailed Jun. 8, 2012, from German Application No. 10 2012 002 250.6 (11 pages).
(Continued)

*Primary Examiner* — Jacob T Minskey
*Assistant Examiner* — Vishal I Patel
(74) *Attorney, Agent, or Firm* — Kilpatrick Townsend & Stockton LLP

(57) ABSTRACT

The invention relates to an applicator device for applying wrapping labels (13) to packagings (15), having a transverse transport device (19) which is configured for transporting a label, which is first of all dispensed by a label dispenser, in particular a label printer (11), in the vertical direction into an intermediate position, from the intermediate position trans-
(Continued)

Figure 1:
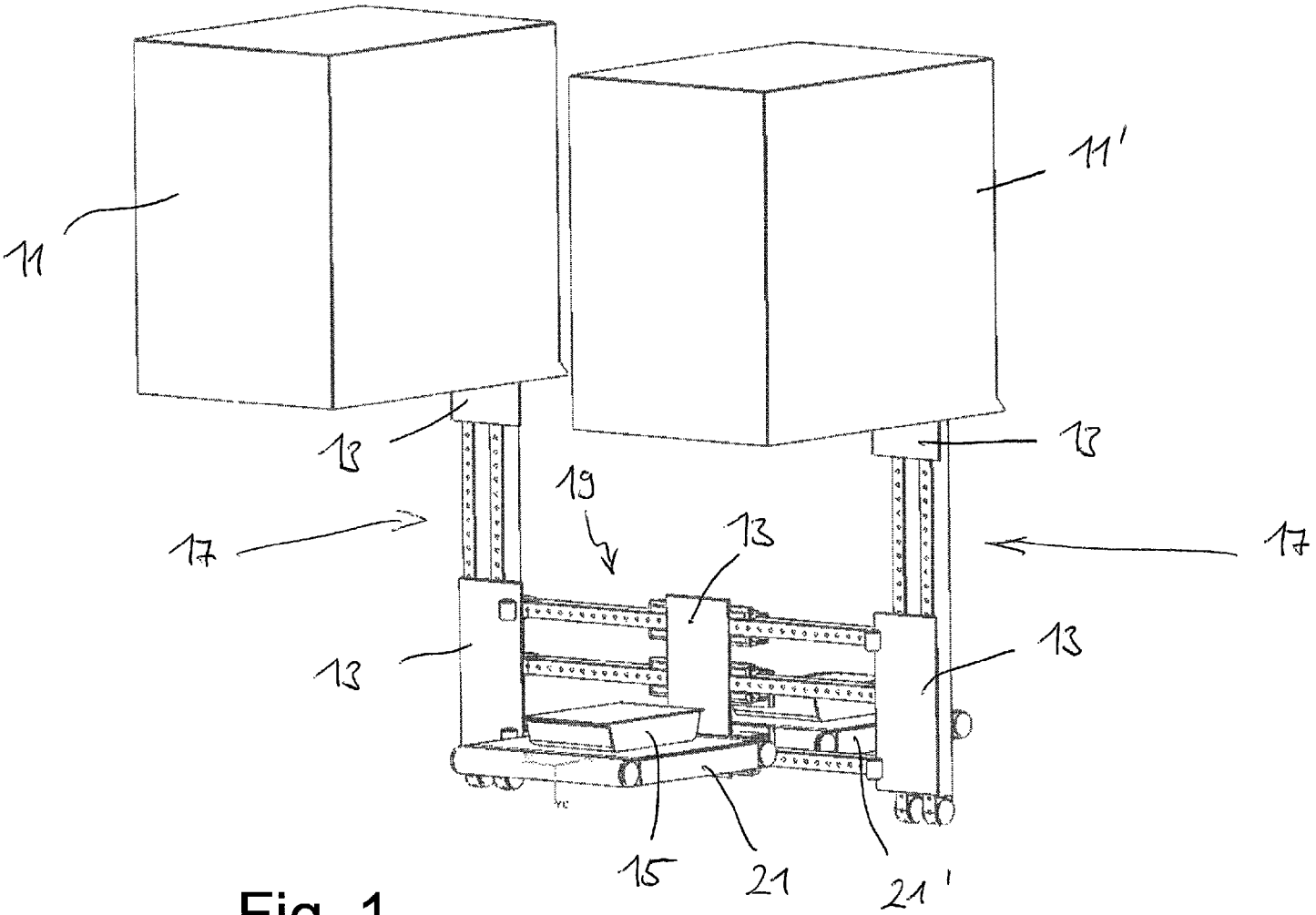

versely with respect to the vertical into an application position, in which the label can be received by a packaging which is running through.

16 Claims, 4 Drawing Sheets

(51) Int. Cl.

| | |
|---|---|
| ***B65C 9/36*** | (2006.01) |
| ***B65C 1/04*** | (2006.01) |
| ***B65C 1/02*** | (2006.01) |
| ***B65C 9/30*** | (2006.01) |

(52) U.S. Cl.
CPC ..... *B65C 9/30* (2013.01); *B65C 9/36* (2013.01); *Y10T 156/10* (2015.01); *Y10T 156/1768* (2015.01)

(56) References Cited

U.S. PATENT DOCUMENTS

| | | | | |
|---|---|---|---|---|
| 6,155,322 | A | 12/2000 | Landan et al. | |
| 6,173,551 | B1 * | 1/2001 | Bowman, Jr. ..... | B65B 61/025 53/131.4 |
| 2009/0056872 | A1 | 3/2009 | Grove | |
| 2009/0199961 | A1 | 8/2009 | Georg | |
| 2015/0007936 | A1 * | 1/2015 | Bernhard ..... | B65C 1/042 156/277 |

FOREIGN PATENT DOCUMENTS

| | | | |
|---|---|---|---|
| GB | 2040869 | A | 9/1980 |
| GB | 2328427 | A | 2/1999 |
| GB | 2336580 | A | 10/1999 |
| GB | 2456511 | A | 7/2009 |
| IT | BO20090050 | A | 8/2010 |

OTHER PUBLICATIONS

International Search Report mailed Apr. 24, 2013, from PCT Application No. PCT/EP2013/052253 (8 pages).
International Preliminary Report on Patentability mailed Aug. 12, 2014, from PCT Application No. PCT/EP2013/052253 (16 pages).

* cited by examiner

APPLICATOR DEVICE FOR WRAPPING LABELS

This application is a U.S. National Phase of International Application No. PCT/EP2013/052253, filed Feb. 5, 2013, which claims priority to German Patent Application No. 102012002250.6, filed Feb. 6, 2012, the disclosures of which are incorporated by reference herein.

The present invention relates to an applicator apparatus for applying wrapping labels to packaging.

As a rule, packaging is provided with different labels at a number of sides. The labels can be provided with price information and weight information or with other product information. In so-called C-wrap labeling, a label is used, a so-called wrapping label, which can bear all the product information and which is applied to the packaging such that it surrounds the packaging from three sides. It is thus possible not only to reduce the number of the labels to be applied to a packaging and thus the number of required changes of label rolls, but also the labels can simultaneously be used for the secure closing of the packaging.

In known applicator apparatus, the labels are dispensed vertically downwardly from a label printer into an application position for this purpose. In the application position, the labels hang through an opening in a conveyor belt on which the packaging is transported. In the application position, the respective label can then be taken up by a respective packaging passing through. The label is in this respect first applied to the front face of the packaging and is subsequently also pressed onto the upper side and onto the lower side of the packaging by means of corresponding brushes or the like. Such an applicator apparatus is known, for example, from U.S. Pat. No. 6,155,322. The labels can, however, also be dispensed from bottom to top, as is known from US 2009/0056872 A1.

Such applicator apparatus, however, have the disadvantage that only a relatively small throughput can be achieved. This is primarily due to the fact that the printing process with wrapping labels takes a comparatively long time due to their as a rule larger length in comparison with conventional labels.

It is the underlying object of the invention to provide an applicator apparatus of the initially named kind which can ensure a high throughput.

This object is satisfied by an applicator apparatus having the features of claim 1 and in particular by an applicator apparatus having a transverse transport device which is configured to transport a label initially dispensed in a vertical direction into an intermediate position from a label dispenser, in particular a label printer, from the intermediate position transversely to the vertical, in particular horizontally, and/or transversely to the dispensing direction, into an application position in which the label can be taken up from a packaging passing through.

The dispensing, in particular printing, of labels, on the one hand, and the supply of labels into the application position or the dwelling of the labels in the application position, on the other hand, can in particular be decoupled from one another by the provision of the transverse transport device. The dispensing or printing of the next label can therefore at least already be started or even completed, while the preceding label is still located between the intermediate position and the application position or the application of the preceding label onto a packaging has not yet been finally completed. The application apparatus is in particular configured to carry out a dispensing, in particular a printing, and a transfer process through the transverse transfer device in a simultaneous manner and/or in a manner overlapping one another in time. The throughput of the applicator apparatus can hereby be increased with respect to applicator apparatus known from the prior art. A linear transport in particular takes place into the intermediate position and/or application position.

A packaging passing through is to be understood as a packaging moved relative to the applicator apparatus. A label dispensed in the vertical direction is also to be understood as a label dispensed at least substantially in the vertical direction. For example, the label can be dispensed at an inclination of up to 30°, in particular up to 15°, with respect to the vertical. The applicator apparatus can, for example, be a price labeler.

The packaging is preferably transported on a conveyor belt or transport belt. The applicator apparatus can be combined with alternatively manufactured label dispensers, in particular label printers, conveyor belts for packaging and/or dynamic scales, or they can also be part of the claimed applicator apparatus. Accordingly, the applicator apparatus can comprise a label dispenser, in particular a label printer, which is configured to dispense the label in a vertical direction into the intermediate position, and/or a transport device which is configured and arranged to transport the packaging along a transport path which leads through the application position.

The transverse transport device is in particular configured as a transverse conveyor belt, in particular as a horizontal conveyor belt, which can comprise at least two individual belts extending in parallel with one another, with the spacing of the two outer individual belts preferably being adjustable with respect to one another. The height of the uppermost individual belt is in particular adjustable. The transverse conveyor belt can hereby be matched to the size of the respective labels.

In accordance with an embodiment of the invention, a vertical transport device, in particular a vertical conveyor belt, arranged to the side of the transverse transport device is provided which is configured to transport a label dispensed from the label dispenser into the intermediate position or at least to assist this transport such as can be the case when the label is still partly stuck in the label dispenser and is also at least moved forward through the label dispenser. The vertical transport device can likewise comprise at least two individual belts extending in parallel with one another.

The intermediate position preferably comprises a predefinable, adjustable vertical position. The label overhang can hereby be set to the upper side and to the lower side of the packaging, i.e. the length of the sections of the wrapping label which are located at the upper side and lower side of the packaging after application.

The transverse transport device and/or the aforesaid vertical transport device preferably comprises means to hold the label at the transverse transport device and/or at the vertical transport device, in particular on a transport by vacuum or suction air.

For the taking up of the label by the transverse transport device, an in particular at least partly movable pressing device, in particular a pressing roll, can be provided with which the label can be pressed onto the transverse transport device. The pressing device can, for example, be moved in a linear fashion to the label or pivoted inwardly to the label.

To release the label from the transverse transport device, in particular when the label has reached the application position, a lifting mechanism can be provided. The lifting mechanism can comprise means to hold the label by vacuum or suction air at lifting elements which are movable transversely, in particular perpendicular, to the conveying plane of the transverse transport device. A lifting of the label from the transverse transport device is, however, not absolutely necessary. It is generally also possible that a packaging automatically releases the label from the transverse transport device when the label passes through.

In accordance with a further embodiment of the invention, two vertical transport devices are provided which are arranged at two oppositely disposed sides of the application position. If the label dispensers are part of the application apparatus, two label printers are also preferably provided which are then likewise arranged at the two oppositely disposed sides of the application position. The throughput of the application apparatus can be further increased by the use of two label dispensers at both sides of the application position. In addition, different labels can hereby also be applied and an uninterrupted operation can be ensured on a change of the label roll.

It is of advantage in this connection if the apparatus is configured to supply the labels alternately to the application position from the two oppositely disposed sides. It is preferred for this purpose if the transverse transport device is configured as a conveyor belt which can be operated in both directions of rotation.

A brushing on device, for example brushes or the like, can be provided by which the label taken up by the packaging can be brushed onto the packaging or can be pressed onto the packaging. The labels can hereby so-to-say be brushed smooth on passing by. Additionally or alternatively, guide means can be provided which counteract a delay in the movement of the packaging when taking up the label. The packaging can, for example, be clamped by means of lateral transport belts to counteract slippage on the taking up of the label which sets a certain resistance toward the movement of the packaging.

The invention furthermore also relates to a method for applying wrapping labels onto packaging, wherein a label dispensed from a label dispenser, in particular from a label printer, in a vertical direction and first transported into an intermediate positions is transported by a transverse transport device from the intermediate position transversely to the vertical into an application position in which the label can be taken up by a packaging passing through.

Preferred embodiments of the method in accordance with the invention result in an analog manner from the further developments of the applicator apparatus in accordance with the invention.

Advantageous embodiments of the invention are set forth in the dependent claims, in the description and in the drawing.

Figure 2:
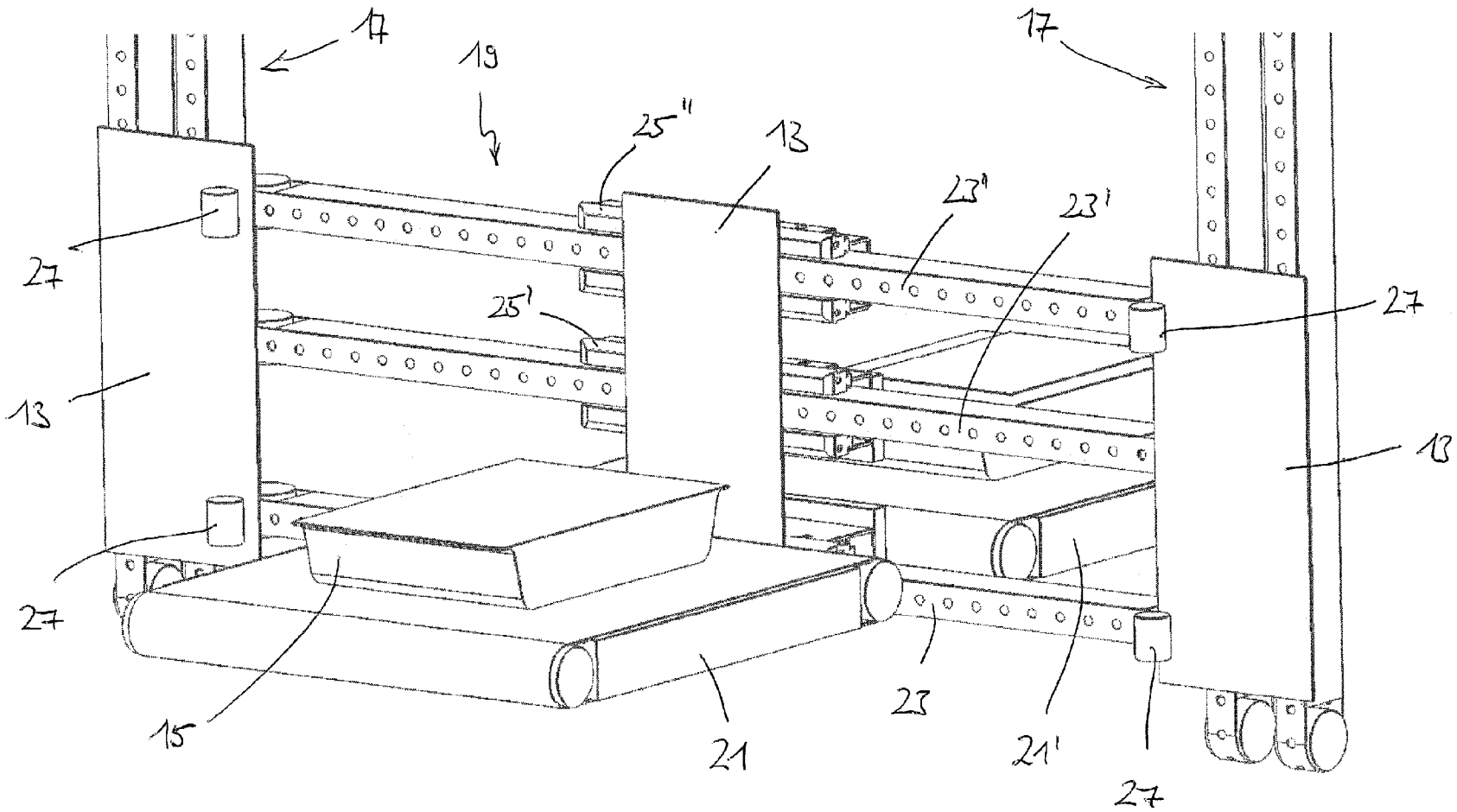
Figure 3:
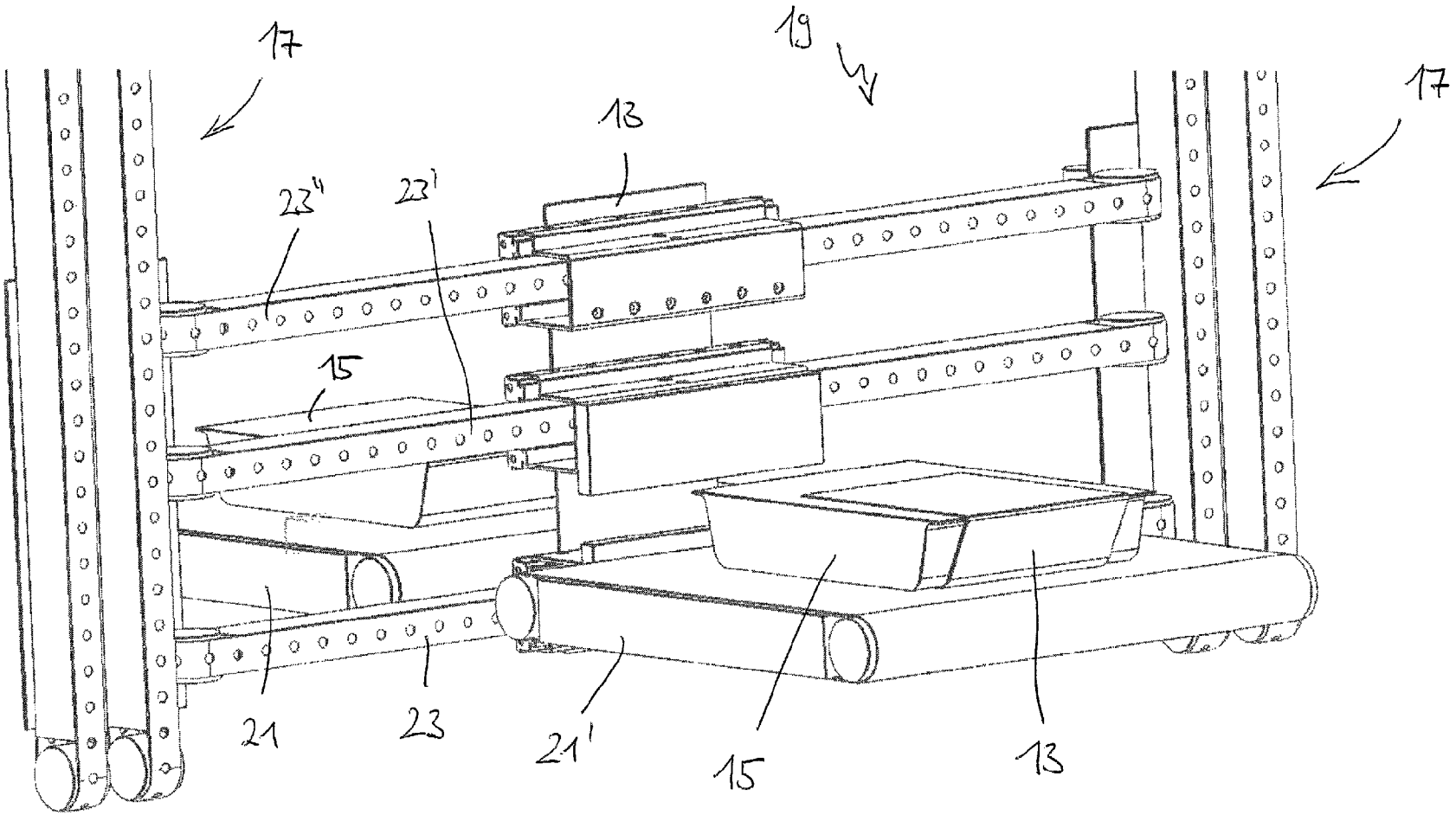
Figure 4B:
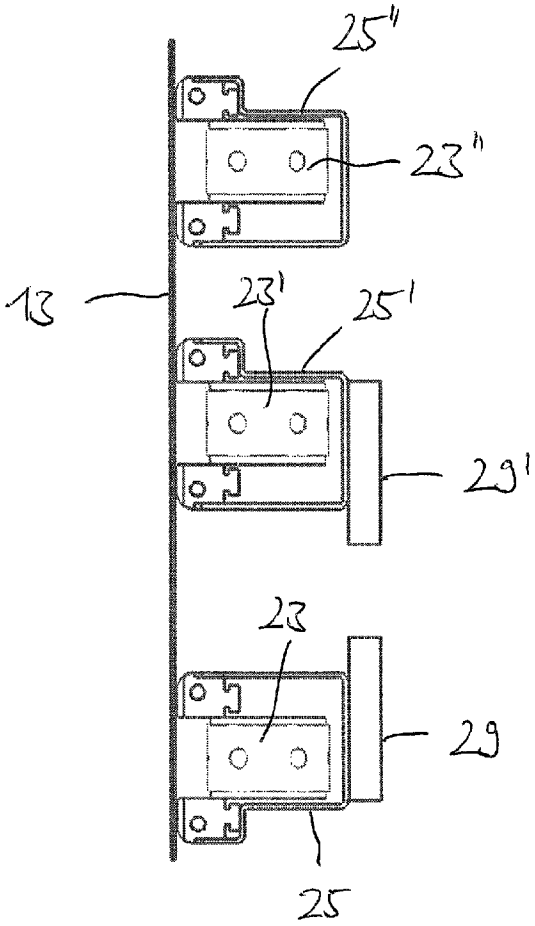
Figure 4A:
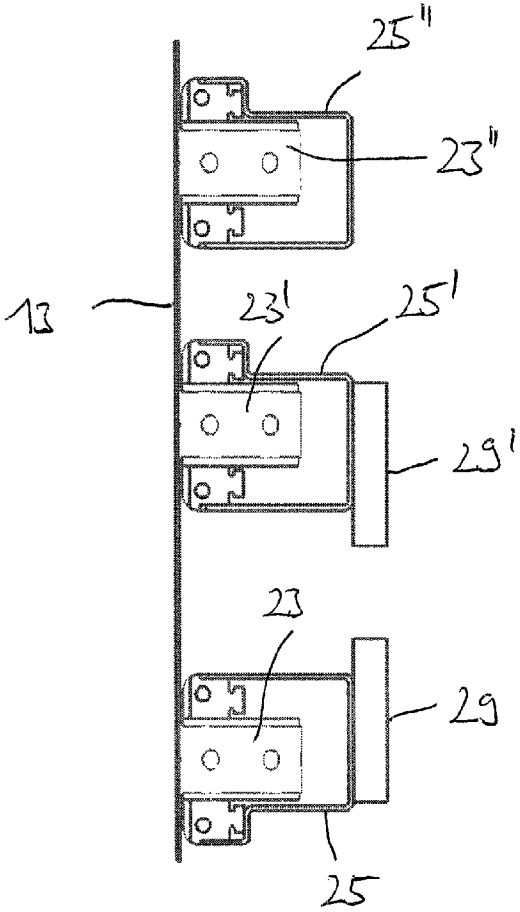

A non-restricting embodiment of the invention is represented in the drawing and will be described in the following. There are shown, schematically in each case FIG. 1 an applicator apparatus in accordance with the invention with a transverse transport belt in a perspective frontal view;

FIG. 2 the applicator apparatus from FIG. 1 in an enlarged representation;

FIG. 3 the applicator apparatus from FIG. 1 in a perspective rear view;

FIG. 4*a* a side view of a lifting mechanism in a retracted state; and

FIG. 4*b* a side view of the lifting mechanism of FIG. 4 in an extended state.

The applicator apparatus in accordance with the invention shown in FIGS. 1 to 3 comprises a first label printer 11 which is configured to dispense elongate labels 13 at least approximately vertically, in particular downwardly. The respective label 13 is ultimately used to be applied onto three sides of a packaging 15 (cf. FIG. 3). The applicator apparatus is therefore a C-wrap applicator and the label 13 can be called a wrapping label.

The dispensed labels 13 are transported further downwardly into an intermediate position from a first vertical conveyor belt 17 which comprises two individual belts extending in parallel with one another in the example shown. The vertical position of the labels 13 is predefined and adjustable in the intermediate position, i.e. it is possible to set how far the labels 13 are transported downwardly by the vertical conveyor belt 17. Ultimately, the label overhang can hereby be set at the upper side and at the lower side of the packaging 15.

The labels 13 are transported from the intermediate position by means of a transverse conveyor belt 19 horizontally into an application position (cf. FIGS. 1 and 2) which is located in the transport path of the packaging 15 so that the labels 13 can be taken up by the packaging 15 passing through. The labels 13 are in this respect located between two conveyor sections 21, 21' of a conveyor belt which are arranged at a sufficient spacing behind one another, with the packaging 15 being transported on the conveyor belt.

The labels 13 are held at the vertical conveyor belt 17 and at the transverse conveyor belt 19 in each case by suction holes to which vacuum is applied. To transfer the labels 13 from the vertical conveyor belt 17 to the transverse conveyor belt 19, pressing rollers 27 are provided which can be pressed onto the rear side of the labels 13 via a pressing device otherwise not shown so that the front sides of the labels 13 are in turn pressed onto the transverse conveyor belt 19.

The provision of an intermediate position upstream of the application position makes it possible already to print a new label 13 while the preceding label 13 is still located in the application position or was at least not yet completely taken up by a packaging 15. The throughput can hereby be increased with respect to applicator apparatus in which the labels are dispensed directly into the application position and which only begin with the time-consuming printing of a new label when the preceding label has again left the positioning position.

The first label printer 11 and the first vertical conveyor belt 17 are each arranged at the one of the two sides of the application position. Furthermore, a corresponding second label printer 11' and a corresponding second vertical conveyor belt 17' are provided at the other one of the two sides of the application position which are connected in an analog manner to the first label printer 11 and the first vertical conveyor belt 17 to the transverse conveyor belt 19 which extends for this purpose over the total path between the two vertical conveyor belts 17, 17'. This allows labels 13 to be supplied to the application position alternately from the left and from the right. It is necessary for this purpose with the design shown that the transverse conveyor belt 19 can be operated in both directions of rotation. The throughput of the applicator apparatus can hereby be further increased.

The transverse conveyor belt 19 comprises a total of three individual belts 23, 23', 23" extending parallel to one another, in particular horizontal individual belts, with the upper one of the individual belts 23" being adjustable in its height, for example mechanically via a hand crank. The height of the transverse conveyor belt can hereby be adapted to the length of the labels 13, i.e. a larger spacing between the two outer individual belts 23, 23" is selected with longer labels 13. The lower individual belt 23 is arranged beneath the transport plane of the packaging 15; the middle and the upper individual belt 23', 23" are each arranged above this transport plane. The middle individual band 23' is arranged above the packaging 15 which moves through the application position. The middle individual belt 23' is likewise adjustable in its height to be able to process packaging 15 of different heights.

In the application position, the labels 13 can be lifted from the transverse conveyor belt 19 by a lifting mechanism. A transverse transport of the labels 13 then no longer takes place with a transverse conveyor belt 19 still moving. The lifting mechanism for this purpose comprises pressing rails 25', 25", 25'" (cf. in particular FIG. 4) which can be lifted from or are adjustable against the conveying direction of the packaging 15 and which are provided for each of the individual belts 23, 23', 23". The pressing rails 25, 25', 25" are likewise provided with suction holes (not shown) to which vacuum is applied to hold the lifted labels 13 at the pressing rails 25, 25', 25" until they are taken up by packaging 15 passing through the application position. The pressing rails 25, 25', 25" are shown in the retracted position in FIG. 4*a*, i.e. the label 13 is still not lifted from the transverse conveyor belt 19. In FIG. 4, in contrast, the pressing rails 25, 25', 25" are extended and the label 13 is released from the transverse conveyor belt 19.

Finally, a brush-on device can be recognized from FIGS. 4*a* and 4*b* which comprises two brushes 29, 29' which are only shown schematically, which are attached to the two pressing rails 25, 25' and which project from the top and bottom into the transport path of the packaging 15 to press the labels 13 firmly onto the upper side and onto the lower side of the packaging 15.

REFERENCE NUMERAL LIST

11 label printer
13 label
15 packaging
17 vertical conveyor belt
19 horizontal conveyor belt
21 conveyor belt section
23 individual belt
25 pressing rail
27 pressing roller
29 brush

The invention claimed is:

1. An applicator apparatus for applying wrapping labels onto packaging, the applicator apparatus comprising:

a transverse transport device which is configured to transport a label dispensed from a label dispenser in a vertical direction and first into an intermediate position, from the intermediate position transversely to the vertical into an application position in which the label can be taken up by a packaging passing through, and wherein the transverse transport device is configured as a transverse conveyor belt.

2. The applicator apparatus in accordance with claim 1 wherein the label dispenser is a label printer.

3. The applicator apparatus in accordance with claim 1, wherein the transverse conveyor belt comprises at least two individual belts extending in parallel with one another.

4. The applicator apparatus in accordance with claim 3, wherein a spacing between the two individual belts can be set with respect to one another.

5. An applicator apparatus for applying wrapping labels onto packaging, the applicator apparatus comprising:

a transverse transport device which is configured to transport a label dispensed from a label dispenser in a vertical direction and first into an intermediate position, from the intermediate position transversely to the vertical into an application position in which the label can be taken up by a packaging passing through;

a vertical conveyor belt arranged to a side of the transverse transport device, with the vertical transport device being configured to transport a label dispensed from the label dispenser into the intermediate position.

6. The applicator apparatus in accordance with claim 1, wherein the intermediate position comprises a predefinable, adjustable vertical position.

7. The applicator apparatus in accordance with claim 1, wherein at least one of the transverse transport device and a vertical transport device comprises means to hold the label at least one of the transverse transport device and the vertical transport device by vacuum.

8. The applicator apparatus in accordance with claim 1, further comprising a pressing device for taking up the label by the transverse transport device wherein the label can be pressed onto the transverse transport device by means of the pressing device.

9. The applicator apparatus in accordance with claim 8, wherein the pressing device is a pressing roller.

10. The applicator apparatus in accordance with claim 1, further comprising a lifting mechanism for releasing the label from the transverse transport device.

11. An applicator apparatus for applying wrapping labels onto packaging, the applicator apparatus comprising:

a transverse transport device which is configured to transport a label dispensed from a label dispenser in a vertical direction and first into an intermediate position, from the intermediate position transversely to the vertical into an application position in which the label can be taken up by a packaging passing through, wherein two vertical transport devices are provided which are arranged on two oppositely disposed sides of the application position.

12. The applicator apparatus in accordance with claim 11, wherein the applicator apparatus is configured to supply the labels to the application position alternately from the two oppositely disposed sides.

13. The applicator apparatus in accordance with claim 12, wherein the transverse transport device is configured as a conveyor belt which can be operated in both directions of rotation for the alternating supply.

14. The applicator apparatus in accordance with claim 1, further comprising at least one of a brushing-on device and guide means, wherein the label taken up by the packaging can be brushed onto the packaging by means of the brushing-on device and wherein the guide means can counteract a delay in the movement of the packaging on the taking up of the label.

15. The applicator apparatus in accordance with claim 1, further comprising at least one of a label dispenser and a transport device, wherein the label dispenser is configured to dispense the label in the vertical direction into the intermediate position; and wherein the transport device is configured and arranged in such a manner to transport the packaging along a transport path which leads through the application position.

16. The applicator apparatus in accordance with claim 15, wherein the label dispenser is a label printer.

* * * * *